US005913674A

United States Patent [19]

Shimizu

[11] Patent Number: 5,913,674

[45] Date of Patent: Jun. 22, 1999

[54] SAFETY LIGHTER

[76] Inventor: Tetsunosuke Shimizu, 2211 S. Hacienda Blvd., Suite 107, Hacienda Heights, Calif. 91745

[21] Appl. No.: 09/127,456

[22] Filed: Jul. 31, 1998

[51] Int. Cl.[6] ..... F23Q 1/02

[52] U.S. Cl. ..... 431/153; 431/277

[58] Field of Search ..... 431/277, 153, 431/273

[56] References Cited

U.S. PATENT DOCUMENTS 5,096,414 3/1992 Zellweger ..... 431/153

5,547,370 8/1996 Hwang ..... 431/153

*Primary Examiner*—Carl D. Price

*Attorney, Agent, or Firm*—David & Raymond; Raymond Y. Chan

[57] ABSTRACT

A safety lighter includes two wheel axles which can be easily and firmly engaged to two sides of the spark wheel respectively, so as to properly support the spark wheel on top of the flint and to ensure the spark wheel being absolutely driven by the two wheel axles. Since the spark wheel is supported by the two wheel axles on both side respectively, the two wheel axles will substantially prevent the spark wheel to move aside, so that the spark wheel can permanently remain in a central position between the two wheel axles.

16 Claims, 4 Drawing Sheets

SAFETY LIGHTER

FIELD OF THE PRESENT INVENTION

The present invention relates to disposable lighter, and more particular to a safety lighter that can prevent the minor, especially under 4 years old, to ignite the lighter so as to guarantee the safety of children.

BACKGROUND OF THE PRESENT INVENTION

The traditional designs of the disposable lighter have three merits, i.e. fighting the fire easily, economy and cheap, and easy operation. Therefore the disposable lighters are very popular.

However, for protecting the safety and benefit of children, starting from 1993 to 1994, the U.S. Consumer Product Safety Commission declared that it should stop selling the traditional disposable lighter. In view of protecting the safety of children, it is absolutely necessary and reasonable to do so. Therefore, the U.S. Consumer Product Safety Commission imposed an important regulation that "Child below 4 years old cannot light the lighter".

Accordingly, various kinds of disposable lighter having switching mechanism for rendering the lighter child resistant are developed. Such switching mechanism provides a switch member requiring the adult user to turn on before permitting an operating lever to be depressed to lift a gas pipe to open a gas release valve while a spark is generated by simultaneous rotation of a striker wheel in engagement with a flint. However, such conventional gas lighters with switching mechanism also bear the drawbacks as follows:

1. Numerous of additional elements of the switching mechanism are required to incorporate with the traditional disposable lighter for ensuring the safety feature thereof Such costly switching mechanism not only increases the cost of the lighter, but also increases the manufacturing procedures of the lighter.
2. During the igniting operation of the gas lighter, initially, an additional step of turning the switch member of the switching mechanism to release the locking of the operating lever is needed for enabling the depressing the operating lever to lift the gas pipe to open the gas release valve, which complicates the manipulation of ignition.

In fact, the normal pressure of a thumb of a 4 years old child is about 1 kg. The maximum pressure of the thumb is not over 1.5 kg. The normal procedure for lighting the disposable lighter is required to press the side and spark wheel so as to spark the flint and light a fire. At the same time, the lever must be pressed down to release the gas (the normal pressure to release gas is 0.5–1 kg). As mentioned above, most of the disposable lighters are incorporated switching mechanism to lock the gas lever or the spark wheel in order to prevent the children from igniting fire. However, children are excellent in learning. Some smart or brilliant children can pay attention and pretend the adult to release such switching mechanism and ignite the fire.

Accordingly, it is not a wise way of trying to lock the spark wheel or the gas lever. A better way to prevent the children from igniting a lighter is to design a safety lighter that the child below 4 years old does not has the enough power to ignite it. A typical example if disclosed in a U.S. Pat. No. 5,096,414 owned by Zellweger, which comprises a stiker wheel acting on a spark stone. The striker wheel is disposed between two plates of greater diameter than and freely rotatable with respect to the wheel. Actuation of this latter is obtained by friction thanks to the deformation of the pulp of the thumb of the user, and may not be driven by a child as the pulp of the finger of children is not sufficiently thick.

U.S. Pat. No. 5,547,370, owned by Hwang, is a further improvement of Zellweger's patent. Similar to Zellweger's patent, Hwang's patent also includes a wheel axle mounted between two upright supports at the top of a butane wheel, two driving wheels mounted around the wheel axle between the upright supports, and a striker wheel fixedly mounted around the wheel axle and disposed in contact with a spring-supported flint below and turned by the driving wheels through the wheel axle to strike the spring-supported flint in producing sparks. The improvement is that the wheel axle is made of polygonal cross section, having two round rods at two opposite ends loosely inserted into a respective axle hole on each upright support so as to ensure a better connection between the striker wheel and the wheel axle.

However, both the Zellweger's and Hwang's patents still bear the following drawbacks:

1. The assembly cost is higher because special care and measurement must be applied to ensure the striker wheel is located in a center position of the wheel axle. Especially in the Hwang's patent, the central polygonal hole of the striker wheel must be exactly equal to the size of the polygonal wheel axle. If it is too small, it is impossible to insert the wheel axle therethrough. It is too big, the striker wheel may not be firmly held in center position. How to punch in the polygonal wheel axle through the polygonal hole of the striker wheel and how to ensure the striker wheel located in the central position of the wheel axle become a headache of Hwang's patent.
2. Accordingly, a slight clearance would be existed between the striker wheel and the wheel axle so as to facilitate the polygonal wheel axle to insert through the central polygonal hole of the striker wheel. Normally, the rotation of the wheel axle can drive the striker wheel to rotate with no problem. However, the striker wheel may gradually move aside after using for a period of time. If such condition happens, the center of the striker wheel will not remain aligning with the flint properly, that may unavoidably affect the ignition of the lighter. Malfunction may also occur. The tip of the flint may get stuck between the driving wheel and the striker wheel.

SUMMARY OF THE PRESENT INVENTION

A main object of the present invention is to provide a safety lighter having two wheel axles which can be easily and firmly engaged to two sides of the spark wheel respectively, so as to properly support the spark wheel on top of the flint and to ensure the spark wheel being absolutely driven by the two wheel axles.

Another object of the present invention is to provide a safety lighter, wherein the spark wheel can be easily mounted on a central position between the two supporting walls. Since the spark wheel is supported by the two wheel axles on both side respectively, the two wheel axles will substantially prevent the spark wheel to move aside, so that the spark wheel can permanently remain in a central position between the two wheel axles.

Another object of the present invention is to provide a safety lighter, which does not require to incorporate with any additional part or element in order to provide safety feature for preventing the children to ignite the lighter. Moreover, the assemble of the spark wheel and the two wheel axles are as easy as simply by respectively studding two inner ends of the two wheel axles to the two side holes of the spark wheel. Therefore, the manufacturing cost and procedures of the present invention remain as usual and do not need to be increased as the conventional safety lighters did.

In order to accomplish the above objects, the present invention provides a safety lighter which comprises a supporting frame and an ignition means. The supporting frame is disposed on a gas reservoir having a valve which is actuated by a gas lever pivotally mounted on the supporting frame for releasing gas therefrom. The ignition means comprises a flint supported by a resilient element and a spark wheel which is rotatably mounted on the supporting frame. The spark wheel has an outer striking surface in contact with the flint. The flint is retained urging against the striking surface of the spark wheel by means of the resilient element for generating sparks directed toward the valve when the striking surface is driven to rotate against the flint. The supporting frame comprises a pair of supporting walls protruded on opposite sides of the gas lever from a frame cover sealedly secured onto the gas reservoir. Each of the supporting walls has a circular supporting hole provided thereon for mounting the spark wheel between the two supporting walls.

The characteristic improvement of the present invention is that two sides of the spark wheel each has an axle hole which periphery has a plurality of evenly spaced engaging indentions. The ignition means further comprises two wheel axles and two driving wheels. Each of the driving wheels has an outer kurling surface adapted for better contact by a user. Each of the wheel axles has a round supporting axle for rotatably inserting into the respective circular supporting hole, a driving axle for inserting into the respective axle hole of the spark wheel wherein a periphery of the driving axle has a plurality of evenly spaced protrusions adapted for firmly engaging with the respective engaging indentions of the corresponding axle hole of the spark wheel, and a round driven body integrally formed between the supporting axle and the driving axle, wherein the driven body has a diameter at least equal to that of the driving axle and larger than that of the supporting axle. A plurality of axial driven spurs are evenly spaced and protruded on an outer circular surface of the driven body. Each of the driving wheels has a central driving hole having a diameter larger than that of the driven body so that the driving wheel would be loosely rotated around the driven body without being depressed. A plurality of axial driving grooves are evenly spaced and indented around a periphery of the driving hole. Accordingly, when a depressing force is applied downwardly to the two driving wheels, the driving grooves thereof are pressed to engage with the driven spurs of the two driven bodies, so that when the driving wheels are depressed and turned, the two driven bodies are driven to strike the spark wheel against the flint.

DETAILED DESCRIPTION OF THE PREFERRED EMBODIMENT

Figure 1:
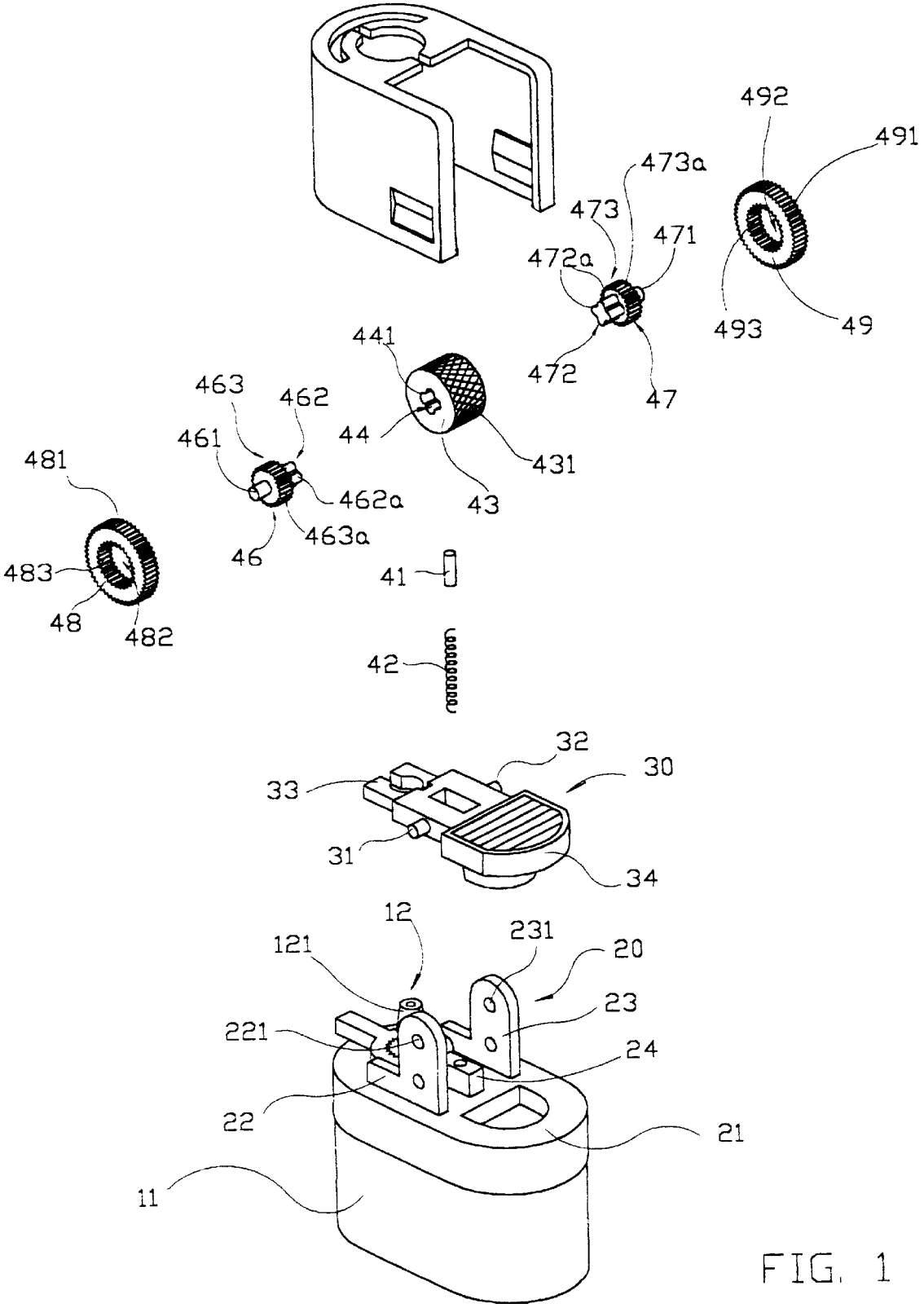
FIG. 1 is an exploded perspective view of a safety lighter according to a first preferred embodiment of the present invention.
Figure 3:
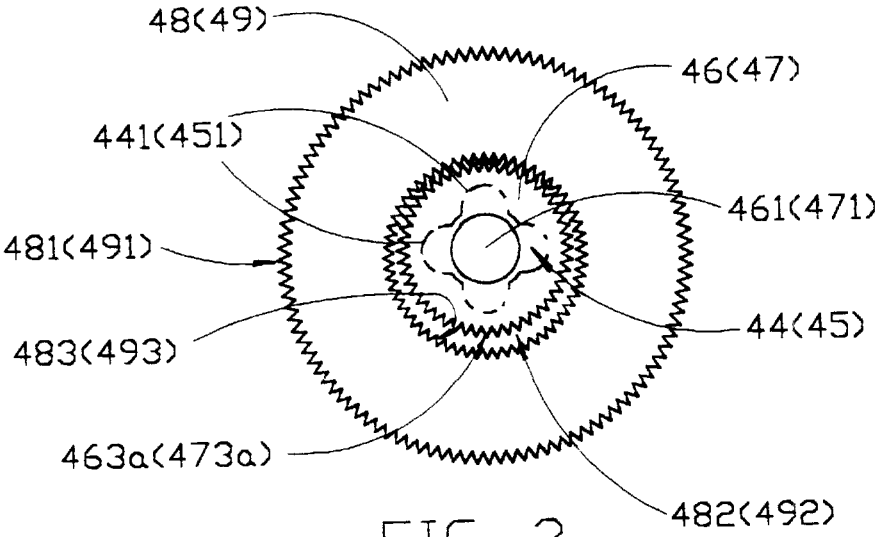
FIG. 3 is partial side view of the driving wheel of the safety lighter according to the above first preferred embodiment of the present invention, illustrating the relationship between the driving wheel and the respective driven body.
Figure 2:
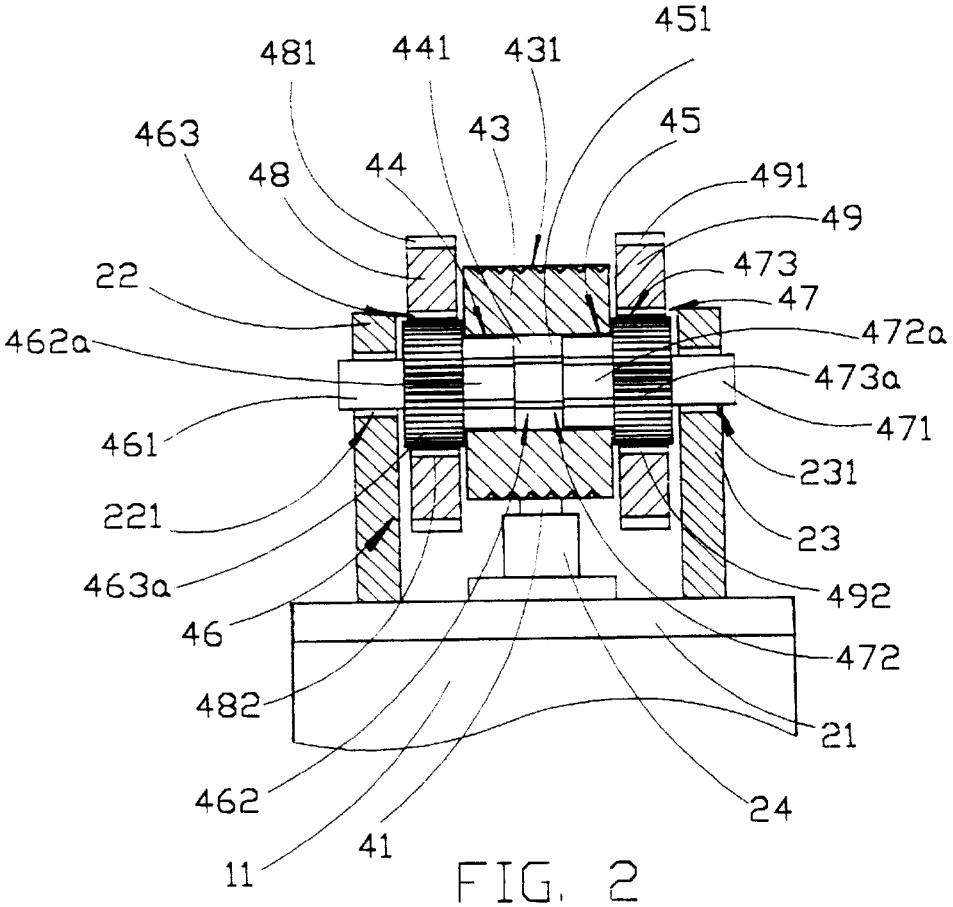
FIG. 2 is a sectional end view of the safety lighter according to the above first embodiment of the present invention.

Referring to FIGS. 1, 2 and 3 of the drawings, a safety lighter of the present invention comprises a supporting frame 20 and an ignition means 40. The supporting frame 20 is disposed on a gas reservoir 11 having a valve 12 which is actuated by a gas lever 30 pivotally mounted on the supporting frame 20 for releasing gas therefrom. The supporting frame 20 is protruded from a frame cover 21 sealedly secured onto the gas reservoir 11 filled with liquid petroleum gas such as butane therein.

The supporting frame 20 comprises a pair of supporting walls 22, 23 protruded on opposite sides of the gas lever 30. The gas lever 30 is pivotally mounted between the two supporting walls 22, 23 by means of two pivots 31, 32 protruded from two opposite sides of the gas lever 30. The gas lever 30 has a front end 33 extending frontward to engage with a nozzle 121 of the gas valve 12 and a depressable rear end 34 extending rearwards of the frame cover 21 for enabling the depressing of the depressable rear end 34 for lifting up the gas nozzle 121 to open the gas valve 12.

The ignition means 40 comprises a flint 41 supported by a resilient element 42 and a spark wheel 43 which is rotatably mounted on the supporting frame 20. The spark wheel 43 has an outer circular striking surface 431 in contact with the flint 41.

The flint 41 and the resilient element 42 are received in a flint housing 24 which is underneath the spark wheel 43 and provided on the frame cover 21 between the two supporting walls 22, 23. An upper portion of the flint 41 must be retained exposing outside the flint housing 24 and urging against the striking surface 431 of the spark wheel 43 by means of the resilient element 42 for generating sparks directed toward the gas valve 12 when the striking surface 431 is driven to turn against the flint 41.

Each of the supporting walls 22, 23 has a circular supporting hole 221, 231 provided thereon for mounting the spark wheel 43 between the two supporting walls 22, 23.

The characteristic improvement of the present invention is that two sides of the spark wheel 43 each has an axle hole 44, 45 which periphery has a plurality of evenly spaced engaging indentions 441, 451.

The ignition means 40 further comprises two wheel axles 46, 47 and two driving wheels 48, 49. Each of the driving wheels 48, 49 has an outer kurling surface 481, 491 adapted for better contact by a user. Each of the wheel axles 46, 47 has a round supporting axle 461, 471 for rotatably inserting into the respective circular supporting hole 221, 231 of the two supporting walls 22, 23, a driving axle 462, 272 for inserting into the respective axle hole 44, 45 of the spark wheel 43 wherein a periphery of the driving axle 462, 472 has a plurality of evenly spaced protrusions 462*a*, 472*a* adapted for firmly engaging with the respective engaging indentions 441, 451 of the corresponding axle hole 44, 45 of the spark wheel 43, and a round driven body 463, 473 integrally formed between the supporting axle 461, 471 and the driving axle 462, 472, wherein the driven body 463, 473 has a diameter at least equal to a maximum size of the driving axle 462, 472 and larger than that of the supporting axle 461, 471. A plurality of axial driven spurs 463*a*, 473*a* are evenly spaced and protruded on an outer circular surface of the driven body 463, 473.

Each of the driving wheels 48, 49 has a central driving hole 482, 492 having a diameter larger than that of the driven body 463, 473, so that the driving wheel 48, 49 can be loosely rotated around the driven body 463, 473 when the driving wheels 48, 49 have not been depressed. A plurality of axial driving grooves 483, 493 are evenly spaced and indented around a periphery of the driving hole 482, 492. Accordingly, when a depressing force is applied downwardly to the two driving wheels 48, 49, the driving grooves 483, 493 thereof are pressed to engage with the driven spurs 463*a*, 473*a* of the two driven bodies 463, 473, so that when the driving wheels 48, 49 are depressed and turned, the two driven bodies 463, 473 are driven to strike the spark wheel 43 against the flint 41.

According to the first preferred embodiment of the present invention, as shown in FIGS. 1 to 3, each of the axle hole 44, 45 of the spark wheel 43 has totally four engaging indentions 441, 451 perpendicularly and outwardly extended so as to render the axle hole 44, 45 in cross shaped. Moreover, the two axle holes 44, 45 can be inwardly extended to form a through hole. Relatively, the two driving axles 462, 472 each has totally four protrusions 462*a*, 472*a* perpendicularly and outwardly extended so as to render the driving axle in cross shaped, wherein the two cross shaped driving axles 462, 472 are arranged to fittedly insert into the two cross shaped axle holes 44, 45 of the spark wheel 43 respectively until the two driving bodies 463, 473 are pressed against the two sides of the spark wheel 43. Therefore, when either one of the two driving axles 462, 472 rotates, the spark wheel 43 can be exactly driven to rotate without any slipping.

As shown in FIG. 2, the two driving axles 462, 472 can be made in tapered form, so as to facilitate the manufacturer to plug the slightly smaller ends thereof into the two axle holes 44, 45 of the spark wheel 43 respectively, wherein the more deeper of the driving axle 462, 472 to be inserted into the respective axle hole 44, 45, the engagement of the driving axle 462, 472 with the spark wheel 43 will be tighter. Furthermore, the spark wheel 43 is rigidly supported between the two wheel axles 46, 47 according to the present invention, so as to rotatably mount between the two supporting walls 22, 23. In other words, the spark wheel 43 is permanently located at a central position between the supporting walls 22, 23 and aligned above the flint 41. The two wheel axles 46, 47 substantially limit and hold the spark wheel 43 in central position that absolutely prevent the spark wheel 43 from moving aside. Therefore, the best striking on the flint 41 can be always achieved.

According to the first preferred embodiment, the driven spurs 43*a*, 473*a* on the driven bodies 463, 473 are in wave form, which are adapted to fittedly engaged with the driving grooves 483, 493 of the driving holes 482, 492 of the two driving wheels 48, 49 respectively when the two driving wheels 48, 49 are downwardly depressed. Therefore, to depress and strike on the two driving wheels 48, 49 at the same time can drive the two wheel axles 46, 47 to turn. The two wheel axles 46, 47 are then drive the spark wheel 43 to rotate and strike against the flint 41 to generate sparks.

Figure 4:
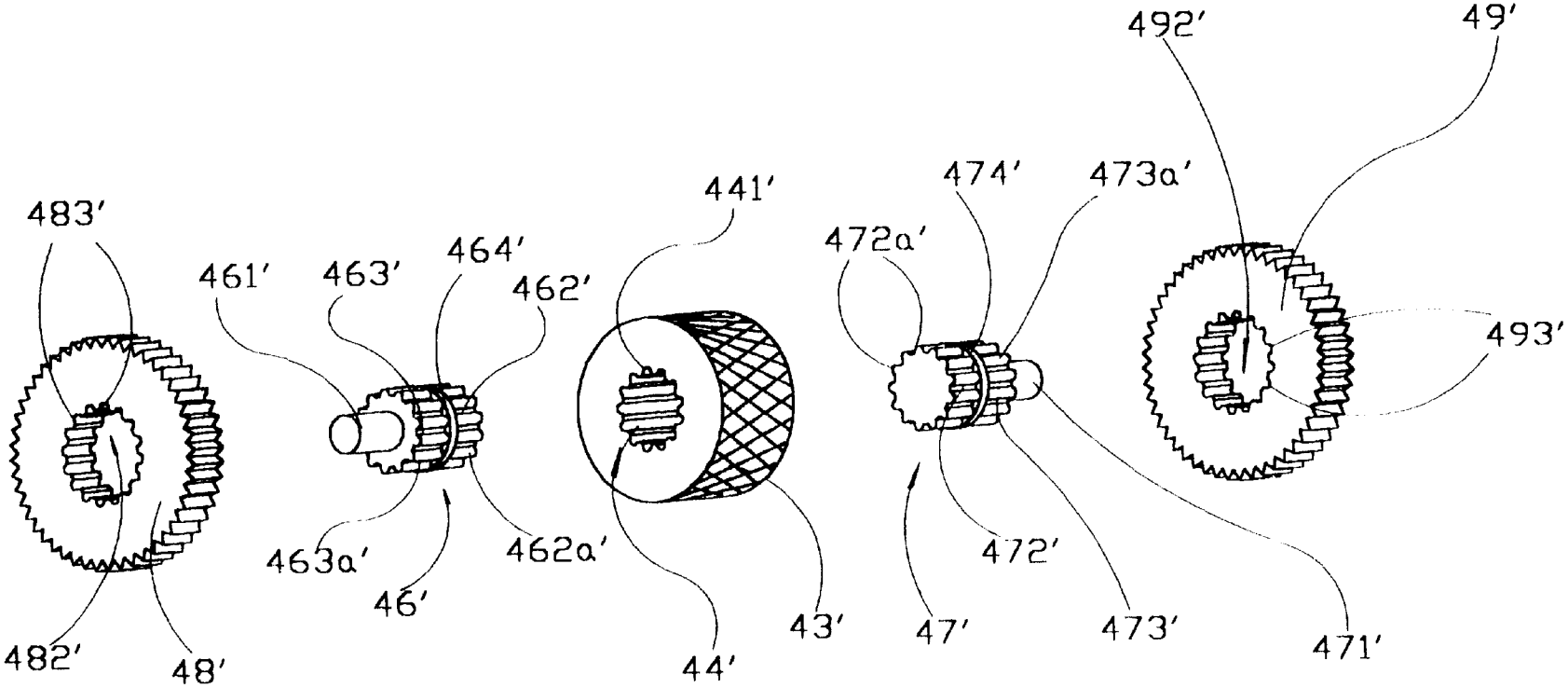
FIG. 4 is an exploded perspective view of a safety lighter according to a second preferred embodiment of the present invention.
Figure 6:
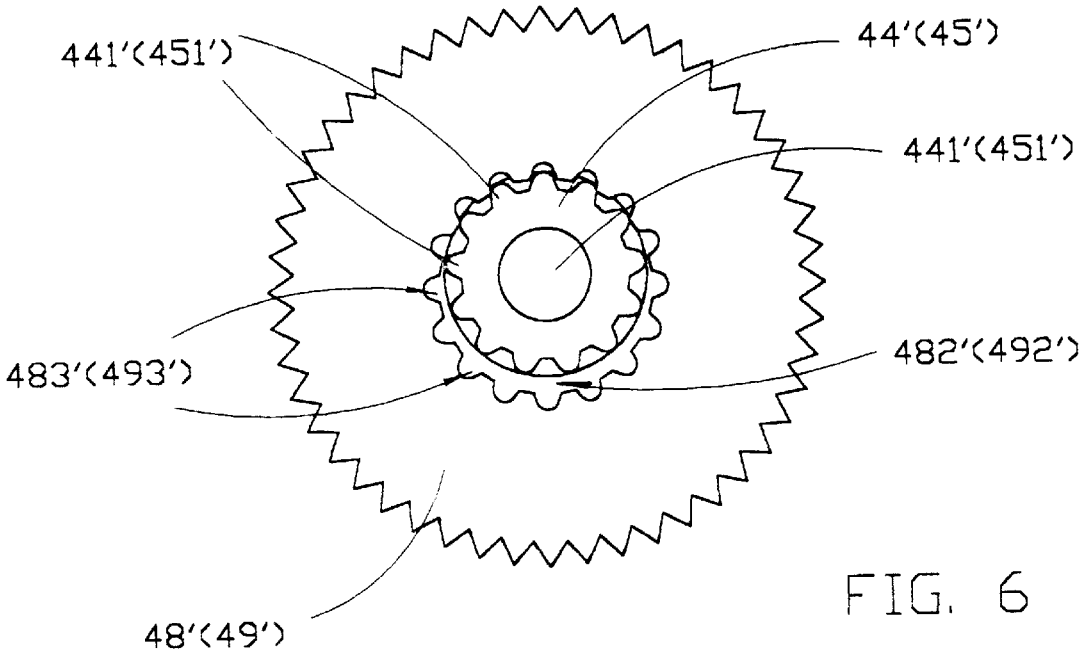
FIG. 6 is partial side view of the driving wheel of the safety lighter according to the above second preferred embodiment of the present invention, illustrating the relationship between the driving wheel and the respective driven body.
Figure 5:
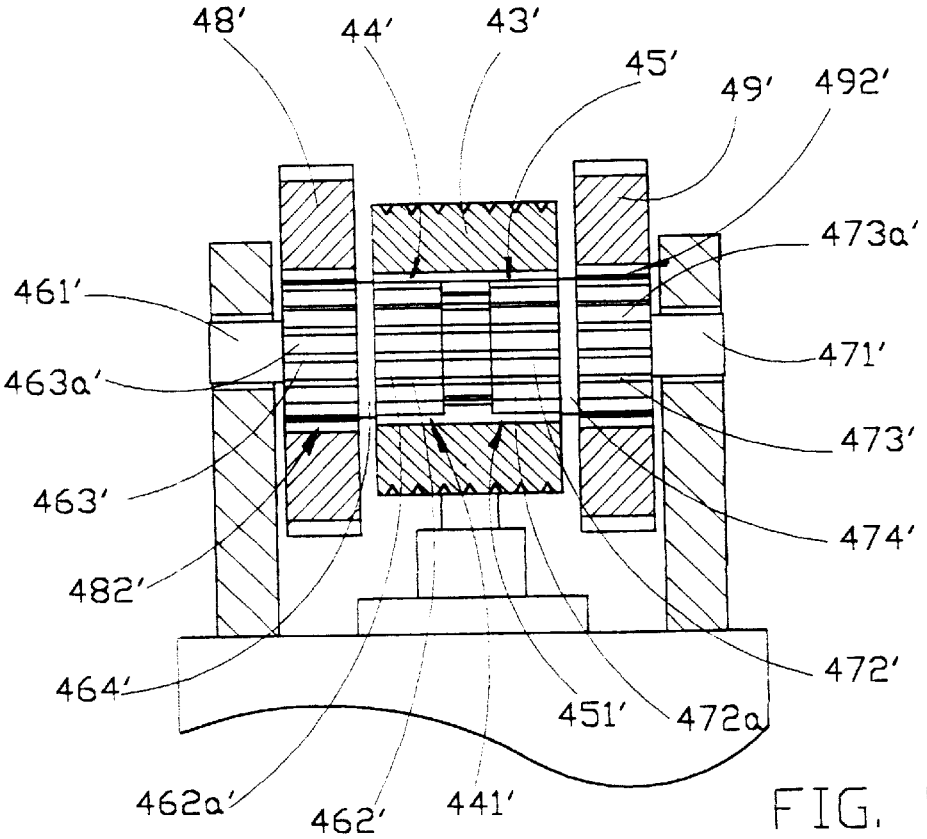
FIG. 5 is a sectional end view of the safety lighter according to the above second embodiment of the present invention.

Referring to FIGS. 4 to 6, a second preferred embodiment of the present invention is illustrated, which is similar to the above first embodiment except that an alternative mode of the ignition means 40 is disclosed. The ignition means 40 also comprises two wheel axles 46' 47' and two driving wheels 48', 49'. Similarly, each of the wheel axles 46', 47' has a round supporting axle 461', 471' for rotatably inserting into the respective circular supporting hole 221, 231 of the two supporting walls 22, 23, a driving axle 462', 472' and a driven body 463', 473', wherein the driving axle 462', 472' and the driven body 463', 473' have the same diameter, and the protrusions 462*a*', 472*a*' on the driving axle 462', 472' and the driven spurs 463*a*', 473*a*' on the driven body 463', 473' are longitudinal semi-circular protruding ribs evenly spaced and extended from the driving axle 462', 472' to the driven body 463', 473'. An isolating rim 464', 474' can be formed between the driving axle 462', 472' and the driven body 463', 473', so that the driving axle 462', 473' can be precisely inserted into the respective axle hole 44', 45' of the spark wheel 43' until the isolating rim 464', 474' is pressed against the corresponding side of the spark wheel 43'.

Relatively, the engaging indentions 441', 451' on the axle holes 44', 45' of the spark wheel 43' and the driving grooves 483', 493' on the driving holes 482', 492' of the driving wheels 48', 49' are also arranged in semi-circular shaped for engaging with the semi-circular protruding ribs as mentioned above. The second preferred embodiment works and operates similar to the above first preferred embodiment.

What is claimed is:

1. A safety lighter, comprising a supporting frame disposed on a gas reservoir having a valve which is actuated by a gas lever pivotally mounted on said supporting frame for actuating said valve to release gas within said gas reservoir therefrom, wherein said supporting frame comprises two supporting walls parallelly protruded on opposite sides of said gas lever and each of said supporting walls has a supporting hole provided thereon; and an ignition means comprising:

a flint supported by a resilient element;

a spark wheel which is rotatably mounted on said supporting frame and has a striking surface in contact with said flint, wherein said flint is retained urging against said striking surface of said spark wheel by means of said resilient element for generating sparks directed toward said valve when said striking surface is driven to strike against, and that two sides of said spark wheel each has an axle hole, a periphery of each of said axle hole having a plurality of evenly spaced engaging indentions;

two wheel axles each having a round supporting axle for rotatably inserting into said respective supporting hole, a driving axle for inserting into said respective axle hole of said spark wheel wherein a periphery of said driving axle has a plurality of evenly spaced protrusions adapted for firmly engaging with said respective engaging indentions of said corresponding axle hole of said spark wheel, and a round driven body integrally formed between said supporting axle and said driving axle, wherein a plurality of axial driven spurs are evenly spaced and protruded on an outer circular surface of said driven body; and two driving wheels, which are supported by said two driven bodies of said two wheel axles respectively, each having an outer kurling surface, a central driving hole having a diameter larger than that of said driven body so as to enable said driving wheel to loosely rotate around said driven body without being depressed, wherein a plurality of axial driving grooves are evenly spaced and indented around a periphery of said driving hole, thereby when a depressing force is applied downwardly to said two driving wheels, said driving grooves thereof are pressed to engage with said driven spurs of said two driven bodies, so that when said driving wheels are depressed and turned, said two driven bodies are driven to strike said spark wheel against said flint.

2. A safety lighter, as recited in claim 1, wherein each of said axle hole of said spark wheel has totally four engaging indentions perpendicularly and outwardly extended so as to render said axle hole in cross shaped, and each of said two driving axles has totally four protrusions perpendicularly and outwardly extended so as to render said driving axle in cross shaped, wherein said two cross shaped driving axles are arranged to fittedly insert into said two cross shaped axle holes of said spark wheel respectively until said two driving bodies are pressed against said two sides of said spark wheel.

3. A safety lighter, as recited in claim 2, wherein said two axle holes are inwardly extended to form a through hole.

4. A safety lighter, as recited in claim 3, wherein said two driving axles are made in tapered form.

5. A safety lighter, as recited in claim 4, wherein said driven spurs on said driven bodies are in wave form, which are adapted to fittedly engaged with said driving grooves of said driving holes of said two driving wheels respectively when said two driving wheels are downwardly depressed.

6. A safety lighter, as recited in claim 3, wherein said driven spurs on said driven bodies are in wave form, which are adapted to fittedly engaged with said driving grooves of said driving holes of said two driving wheels respectively when said two driving wheels are downwardly depressed.

7. A safety lighter, as recited in claim 2, wherein said two driving axles are made in tapered form.

8. A safety lighter, as recited in claim 7, wherein said driven spurs on said driven bodies are in wave form, which are adapted to fittedly engaged with said driving grooves of said driving holes of said two driving wheels respectively when said two driving wheels are downwardly depressed.

9. A safety lighter, as recited in claim 2, wherein said driven spurs on said driven bodies are in wave form, which are adapted to fittedly engaged with said driving grooves of said driving holes of said two driving wheels respectively when said two driving wheels are downwardly depressed.

10. A safety lighter, as recited in claim 1, wherein said two axle holes are inwardly extended to form a through hole.

11. A safety lighter, as recited in claim 1, wherein said two driving axles are made in tapered form.

12. A safety lighter, as recited in claim 1, wherein said driven spurs on said driven bodies are in wave form, which are adapted to fittedly engaged with said driving grooves of said driving holes of said two driving wheels respectively when said two driving wheels are downwardly depressed.

13. A safety lighter, as recited in claim 1, wherein each of said driving axles and each of said driven bodies have a same diameter, and said protrusions on each of said driving axles and said driven spurs on each of said driven bodies are longitudinal semi-circular protruding ribs evenly spaced and extended from said driving axle to said driven body.

14. A safety lighter, as recited in claim 13, wherein an isolating rim is formed between said driving axle and said driven body of each of said wheel axles, so that said driving axle is able to be precisely inserted into said respective axle hole of said spark wheel until said isolating rim is pressed against said corresponding side of said spark wheel.

15. A safety lighter, as recited in claim 14, wherein said engaging indentions on said axle holes of said spark wheel and said driving grooves on said driving holes of said driving wheels are also arranged in semi-circular shaped for engaging with said semi-circular protruding ribs.

16. A safety lighter, as recited in claim 13, wherein said engaging indentions on said axle holes of said spark wheel and said driving grooves on said driving holes of said driving wheels are also arranged in semi-circular shaped for engaging with said semi-circular protruding ribs.

* * * * *